United States Patent [19]

Igbal

[11] Patent Number: 4,662,389

[45] Date of Patent: May 5, 1987

[54] ADJUSTABLE STEM ASSEMBLY

[75] Inventor: Muhammad Igbal, Amherst, Ohio

[73] Assignee: Stanadyne, Inc., Windsor, Conn.

[21] Appl. No.: 877,160

[22] Filed: Jun. 23, 1986

[51] Int. Cl.[4] ..... F16L 5/00

[52] U.S. Cl. ..... 137/359; 137/360; 137/801; 4/191

[58] Field of Search ..... 137/359, 360, 801; 4/191

[56] References Cited

U.S. PATENT DOCUMENTS

| | | | |
|---|---|---|---|
| 2,687,141 | 8/1954 | Baker | 137/360 |
| 2,858,846 | 11/1958 | Parker | 137/360 |
| 2,858,848 | 11/1958 | Wittren | 137/359 |
| 2,896,222 | 7/1959 | Freibott | 4/191 |
| 3,029,831 | 4/1962 | Leete | 137/360 |
| 3,067,436 | 12/1962 | Freibott | 4/191 |
| 3,136,570 | 6/1964 | Lee | 285/193 |
| 3,380,472 | 4/1968 | Leighton | 137/360 |
| 3,836,115 | 9/1974 | Zell | 251/150 |
| 3,856,334 | 12/1974 | Lange | 137/360 |
| 3,971,401 | 7/1976 | Persson | 137/360 |
| 4,083,410 | 4/1978 | Anderson | 285/37 |
| 4,445,529 | 5/1984 | Lagarelli | 137/360 |
| 4,457,342 | 7/1984 | Moen | 137/801 |
| 4,463,460 | 8/1984 | Arnold et al. | 4/191 |

*Primary Examiner*—A. Michael Chambers

*Attorney, Agent, or Firm*—Kinzer, Plyer, Dorn & McEachran

[57] ABSTRACT

A water valve adjustable stem assembly includes a valve housing with an inlet and outlet therein and a valve positioned within the housing. The valve has an inlet and outlet communicating with the housing inlet and outlet and there is a movable valve member to open and close the valve. A valve housing extension is adjustably connected to the valve housing and connects to an escutcheon. A stem extension is attached to the movable valve member and extends within the housing and housing extension and adjustably supports a stem connected thereto. An operating handle is connected to the stem and spaced closely adjacent to the escutcheon. The valve housing is mounted to an underlying support and the adjustment between the valve housing extension and valve housing and the adjustment between the stem extension and stem provides for variably positioning the handle and escutcheon relative to the valve housing mounting.

8 Claims, 3 Drawing Figures

ADJUSTABLE STEM ASSEMBLY

SUMMARY OF THE INVENTION

The present invention relates to water valves and, in particular, to an adjustable stem assembly to provide for varying thicknesses of water valve supports.

Another purpose is an adjustable stem assembly for a water valve which include two areas of adjustment.

Another purpose is a water valve adjustable stem assembly, for example, for use in tub installations, which can accommodate wide variations in the thickness of the tub support.

Another purpose is a simply constructed, reliable adjustable stem assembly for use in a water valve.

Another purpose is an adjustable stem assembly as described which includes one adjustment between the valve housing and the exterior valve escutcheon and a second adjustment between the valve stem and handle and the valve operating member.

Other purposes will appear in the ensuing specification, drawings and claims.

BRIEF DESCRIPTION OF THE DRAWINGS

The invention is illustrated diagrammatically in the following drawings wherein.

DETAILED DESCRIPTION OF THE INVENTION

The present invention is specifically directed to an adjustable stem assembly for a water valve, for example, a valve used with a tub installation. Typically, a plumber/installer, when installing what is known as a Roman tub, encounters wide variations in the deck thickness when the tub is built in place. A plywood frame is generally constructed first and then the plumbing is installed. A layer of tar may be applied to seal the plywood and then masonry and chickenwire, commonly referred to as "mud", is applied and subsequently there is a finish layer of tile. The present invention provides a means for accommodating various thicknesses of mud and tile whereby the valve may be attached to the plywood frame and the escutcheon will rest upon the tile. The adjustable nature of the stem assembly permits substantial variation in thicknesses of the mud supporting the tile.

Figure 1:
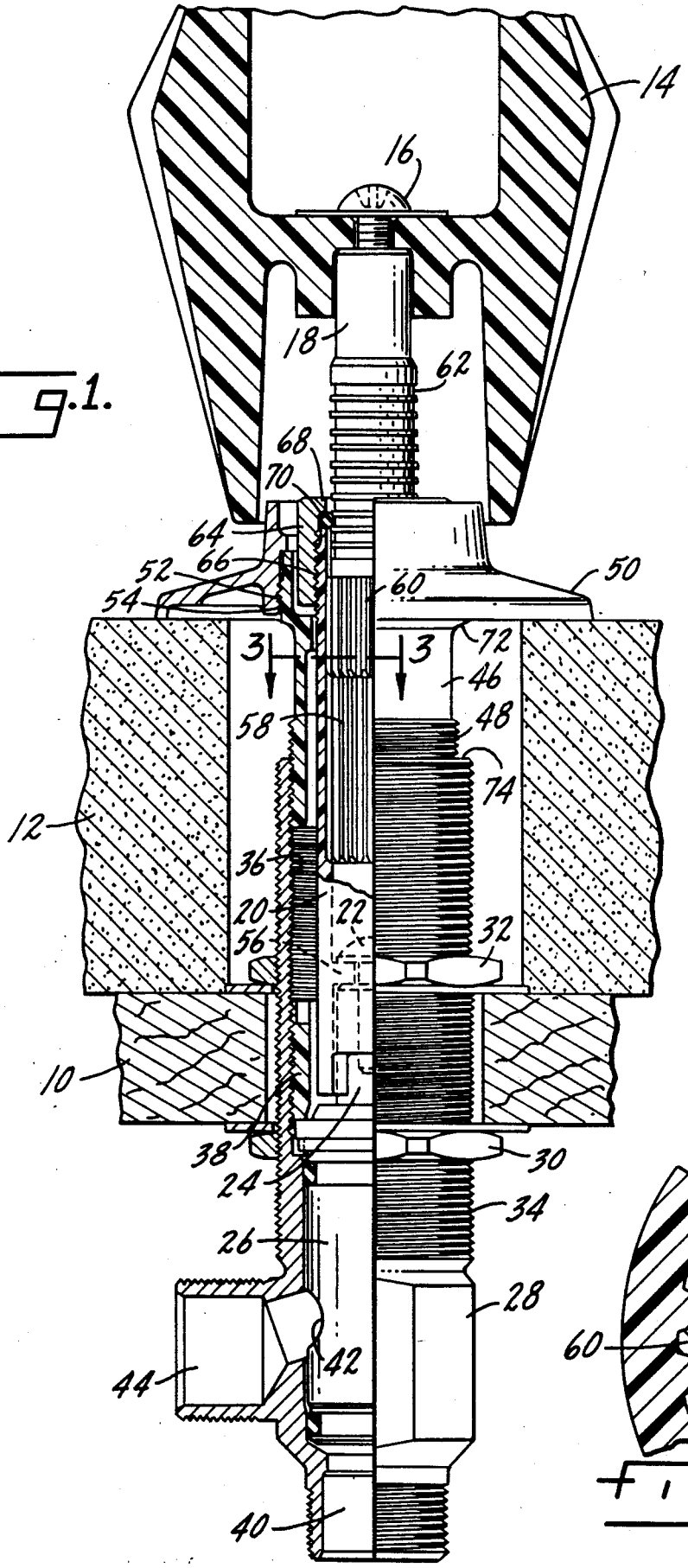
FIG. 1 is a partial axial section through a water valve adjustable stem assembly as described, showing the valve handle and escutcheon in position to accommodate the maximum thickness of support.

In FIG. 1, the plywood support for the valve and for the mud and tile, which finish the tub installation, is indicated at 10 and the mud and tile is indicated at 12. The handle of the valve is indicated at 14 and is held by a screw 16 to a stem 18. The stem 18 is rotatably fixed to a stem extension 20, with the stem extension in turn being fastened by a screw 22 to cartridge operating member 24 of a valve cartridge 26. As described herein, the water supply is a two-handle construction and the valve cartridge may be of the type shown in U.S. Pat. No. 4,395,018, assigned to the assignee of the present application. The invention should not be so limited as obviously other types of valve cartridges may be satisfactory and the invention also has application to single-handle valve constructions.

A valve housing is indicated at 28 and is attached by means of spaced nut and washer combinations 30 and 32 to support 10. The nut and washer combinations are spaced apart a distance equal to the thickness of support 10, with the nuts being mounted on the threaded exterior 34 of housing 28.

The interior of housing 28 is also threaded, as indicated at 36, and a nut 38 is threadably mounted within valve housing 28 to hold valve cartridge 26 in a fixed position within the housing. Valve housing 28 may have a bottom inlet 40, which is in alignment with the bottom of valve cartridge 26, which bottom defines the opening for the valve cartridge. Valve cartridge 26 has an outlet 42 which is in communication with valve housing outlet 44. Accordingly, by manipulation of cartridge operating member 24, the valve cartridge will control the amount of water which flows from housing inlet 40 to housing outlet 44.

Positioned at the upper end of valve housing 28 is a valve housing extension 46, having a lower exterior threaded portion 48, which is in threaded engagement with interior threaded section 36 of the valve housing. Thus, the housing extension can be adjustably positioned relative to the housing. An escutcheon is indicated at 50 and normally rests upon the top of the tile surface, with the combination of the escutcheon and the tile providing the customary decorative exterior for a tub installation. Escutcheon 50 has an interior threaded area 52 which is connected to an exterior threaded portion 54 on valve housing extension 48. Thus, the escutcheon is threadably mounted to the top of the valve housing extension, with the housing extension being threadably mounted to the valve housing.

Figure 3:
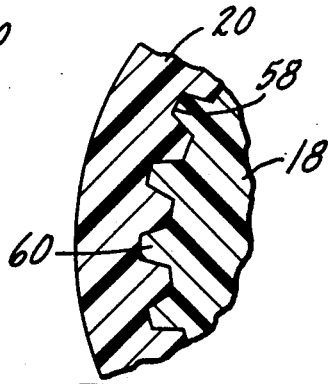
FIG. 3 is a section along plane 3—3 of FIG. 1.

The lower end of stem extension 20 has an integral web 56 through which screw 22 extends so as to mount the stem extension to cartridge operating member 24. Rotation of the stem extension will rotate the cartridge operating member. The interior of stem extension 20 has a plurality of circumferentially spaced, inwardly directed splines 58, illustrated particularly in FIG. 3. Stem 18 has a plurality of outwardly directed splines 60 at a lower end thereof which mesh with splines 58, thereby providing a non-rotational connection between the stem and the stem extension. The stem may be adjustably positioned relative to the stem extension to thus vary the height of the stem and handle 14 relative to the stem extension and the valve member connected thereto.

An upper portion of stem 18 has a plurality of spaced circumferential grooves 62 which are used to fix the position of the stem relative to the stem extension. A nut 64 is threaded to the exterior of stem extension 20, as at 66. The upper end of nut 64 has an inwardly directed flange 68 which overlies an O-ring 70, with the O-ring being positioned in one of grooves 62. The O-ring holds the stem in desired axial position relative to the stem extension.

Figure 2:
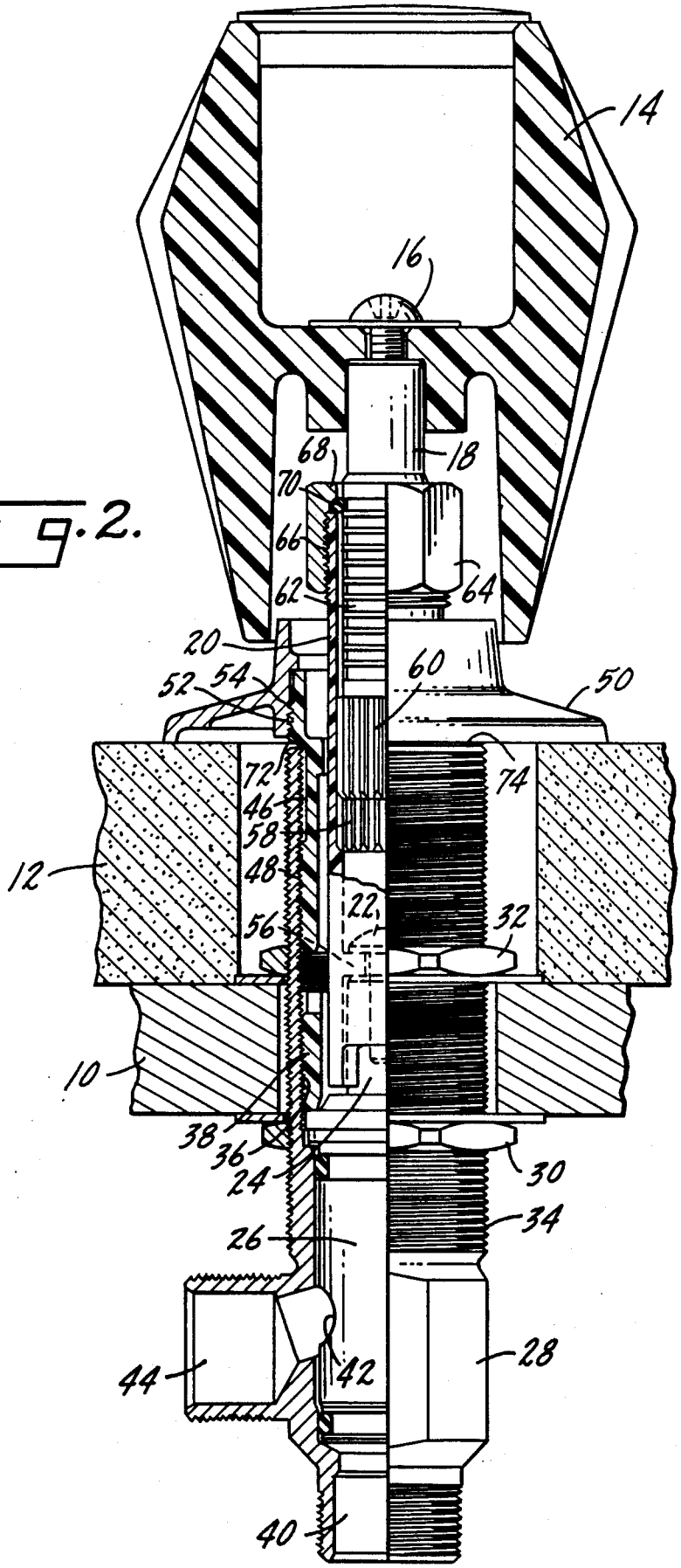
FIG. 2 is an axial section, similar to FIG. 1, showing the valve handle and escutcheon in position for the minimum thickness of support.

The invention is particularly concerned with compensating for variations in the thickness of the mud and tile layer, indicated at 12. FIG. 1 shows the maximum position of the escutcheon and handle relative to the nut and washer mounting of the valve housing, whereas FIG. 2 shows the minimum thickness of mud and tile. There are two adjustments. The first adjustment is between the valve housing extension and the valve housing, and the second adjustment is between the stem and stem extension. Both adjustments are required in varying the height of the escutcheon and handle relative to base support 10. FIG. 2 shows the valve housing extension completely down inside the valve housing, with circumferential flange 72 of the housing extension resting upon the top 74 of the valve housing. If the housing extension is moved out of the housing, it will force the escutcheon up into handle 14, unless the handle is itself moved up. Accordingly, any adjustment between the housing and housing extension requires a compensating adjustment in the position of the stem relative to the stem extension. As the housing extension is moved out of the valve housing, the stem must similarly be moved out of the stem extension so as to retain the proper relationship between handle 14 and escutcheon 50. These two elements are designed to have a predetermined spacing so as to provide for unobstructed operation of the handle. If the escutcheon moves up, the handle must also move up. It is for this reason that there are adjustments between both the parts of the valve assembly which mount the handle and the parts of the valve assembly which mount and position the escutcheon.

The present invention provides for a reliable, easily adjustable mounting for the valve member and its associated escutcheon and handle. The valve housing is attached by nut and washer combinations 30 and 32 to the support 10, upon which the mud and tile are applied. The thickness of the mud and tile determines the position of the valve housing extension relative to the valve housing, and the valve housing extension mounts the escutcheon. The position of the stem relative to the stem extension is determined by the height of the escutcheon. The elements all cooperate to provide unobstructed operation of the handle and a position of the handle relative to the escutcheon which is in accordance with the design of the installation.

Whereas the preferred form of the invention has been shown and described herein, it should be realized that there may be many modifications, alterations and substitutions thereto.

I claim:

1. A water valve adjustable stem assembly including a valve housing having inlet and outlet means therein, a valve positioned within said housing and having a rotable operating member and inlet and outlet means in communication with said housing inlet and outlet means, an escutcheon, a valve housing extension attached to said escutcheon and adjustably connected to said valve housing, a stem extension attached to said operating member and extending within said housing and said housing extension, a stem adjustably connected to said stem extension and a handle connected to said stem, said stem being slidably positioned within said stem extension, and means for fixing the relative position of said stem and stem extension including a plurality of spaced, generally circumferentially extending grooves on the exterior of an upper portion of said stem, a ring positioned to fit within a groove, and a nut threadably attached to the exterior of the stem extension and positioned to overlie the end of said stem extension and position said ring within a stem groove to thereby fix the position of the stem relative to the stem extension, means for mounting said valve housing, the adjustment between said valve housing extension and valve housing and the adjustment between stem extension and said stem providing for variably positioning said handle and escutcheon relative to said valve housing mounting means.

2. The water valve adjustable stem assembly of claim 1 further characterized in that said valve housing extension is threadably connected to said valve housing for relative adjustment therebetween.

3. The water valve adjustable stem assembly of claim 2 further characterized in that said escutcheon is threadably connected to the upper end of said valve housing extension.

4. The water valve adjustable stem assembly of claim 1 further characterized in that at least a portion of the interior of said valve hosuing is threaded, and a nut threaded within said valve housing for positioning said valve within said housing, said nut being outside of said stem extension.

5. The water valve adjustable stem assembly of claim 1 further characterized in that said stem extension is a sleeve, the lower end of which is positioned adjacent said valve, means for attaching said stem extension to said valve operating member, said stem being adjustably positioned within said stem extension.

6. The water valve adjustable stem assembly of claim 1 further characterized in that an exterior portion of said stem has a plurality of outwardly extending splines, with an interior portion of said stem extension having a mating plurality of inwardly extending splines whereby said stem and stem extension are mounted together for relative rotation.

7. The water valve adjustable stem assembly of claim 1 further characterized in that the means for mounting said valve housing includes a threaded exterior on at least a portion of said valve housing, and an adjustment member threaded onto the exterior of said threaded valve housing for mounting thereof.

8. The water valve adjustable stem assembly of claim 7 further characterized by and including spaced nuts threadably mounted on the exterior of said valve housing for mounting against two opposite sides of a support member.

* * * * *